US008662062B2

(12) United States Patent
Darlington

(10) Patent No.: US 8,662,062 B2
(45) Date of Patent: Mar. 4, 2014

(54) COMPOUND ARCHERY BOW

(76) Inventor: Rex F. Darlington, Whittemore, MI (US)

( * ) Notice: Subject to any disclaimer, the term of this patent is extended or adjusted under 35 U.S.C. 154(b) by 728 days.

(21) Appl. No.: 12/657,541

(22) Filed: Jan. 22, 2010

(65) Prior Publication Data

US 2010/0132682 A1 Jun. 3, 2010

(51) Int. Cl.
*F41B 5/10* (2006.01)

(52) U.S. Cl.
CPC ..... *F41B 5/105* (2013.01); *Y10S 124/90* (2013.01)
USPC ..... 124/25.6; 124/23.1; 124/25; 124/900

(58) Field of Classification Search
CPC ..... F41B 5/105
USPC ..... 124/23.1, 25, 25.6, 900
See application file for complete search history.

(56) References Cited

U.S. PATENT DOCUMENTS

| | | | | |
|---|---|---|---|---|
| 5,390,655 | A * | 2/1995 | Mitchell et al. | 124/25.6 |
| 5,649,522 | A * | 7/1997 | Troncoso | 124/25.6 |
| 5,934,265 | A * | 8/1999 | Darlington | 124/25.6 |
| 6,082,346 | A * | 7/2000 | Andrews et al. | 124/25.6 |
| 6,105,565 | A * | 8/2000 | Martin et al. | 124/25.6 |
| 6,250,293 | B1 * | 6/2001 | Andrews | 124/25.6 |
| RE37,544 | E * | 2/2002 | Darlington | 124/25.6 |
| 6,360,735 | B1 * | 3/2002 | Larson et al. | 124/25.6 |
| 6,516,790 | B1 * | 2/2003 | Darlington | 124/25.6 |
| 6,629,522 | B2 * | 10/2003 | Andrews | 124/25.6 |
| 6,691,692 | B1 * | 2/2004 | Adkins | 124/25.6 |
| 6,871,643 | B2 * | 3/2005 | Cooper et al. | 124/25.6 |
| 6,976,484 | B1 * | 12/2005 | Gallops, Jr. | 124/25.6 |
| 6,990,970 | B1 * | 1/2006 | Darlington | 124/25.6 |
| 6,994,079 | B1 * | 2/2006 | Darlington | 124/25.6 |
| 7,059,315 | B2 * | 6/2006 | Blahnik | 124/25.6 |
| 7,082,937 | B1 * | 8/2006 | Land | 124/25.6 |

(Continued)

OTHER PUBLICATIONS

Bow Limb end Photo Image (picture of cam only) Type of Bow: Compound Archery Bow ATA Archery Show 2012.

(Continued)

*Primary Examiner* — Gene Kim
*Assistant Examiner* — Alexander Niconovich
(74) *Attorney, Agent, or Firm* — Reising Ethington PC

(57) ABSTRACT

A compound archery bow includes a bow handle having projecting limbs, and first and second pulleys mounted on the limbs for rotation around respective axes. A bow cable arrangement includes a bowstring cable extending from a bowstring anchor through a bowstring let-out groove on the first pulley and then toward the second pulley. A first power cable extends from a first power cable anchor through a power cable let-out arrangement on the first pulley toward the second pulley, and a second power cable extends from the second pulley through a power cable take-up arrangement on the first pulley to a second power cable anchor on the first pulley. Draw of the bowstring cable away from the handle lets out bowstring cable from the bowstring let-out groove and rotates the first pulley around the first axis, lets out the first power cable from the power cable let-out arrangement on the first pulley and takes up the second power cable into the second power cable take-up arrangement on the first pulley. A power cable stop is disposed on the first pulley at a position to be engaged by the first power cable as the first pulley is so rotated to inhibit further rotation of the first pulley and thereby inhibit further draw of the bowstring cable.

11 Claims, 7 Drawing Sheets

(56) References Cited

U.S. PATENT DOCUMENTS

| | | | | |
|---|---|---|---|---|
| 7,305,979 | B1 * | 12/2007 | Yehle | 124/25.6 |
| 7,311,098 | B2 * | 12/2007 | Gallops, Jr. | 124/25.6 |
| 7,770,568 | B1 * | 8/2010 | Yehle | 124/25.6 |
| 7,997,259 | B2 * | 8/2011 | Wilson | 124/25.6 |
| 8,006,679 | B2 * | 8/2011 | Strother | 124/25.6 |
| 8,220,446 | B2 * | 7/2012 | Batdorf | 124/25.6 |
| 8,276,574 | B1 * | 10/2012 | Wilson | 124/25.6 |
| 8,281,774 | B2 * | 10/2012 | Grace | 124/25.6 |
| 8,360,041 | B2 * | 1/2013 | Strother | 124/25.6 |
| 2004/0074485 | A1 * | 4/2004 | Cooper et al. | 124/25.6 |
| 2005/0193998 | A1 * | 9/2005 | Cooper et al. | 124/25.6 |
| 2010/0051005 | A1 * | 3/2010 | Wilson | 124/25.6 |
| 2010/0263650 | A1 * | 10/2010 | Dahl et al. | 124/25.6 |
| 2011/0023857 | A1 * | 2/2011 | Grace | 124/25.6 |
| 2011/0271939 | A1 * | 11/2011 | Strother | 124/25.6 |
| 2012/0000451 | A1 * | 1/2012 | Grace | 124/25.6 |
| 2013/0000621 | A1 * | 1/2013 | Grace | 124/25.6 |

OTHER PUBLICATIONS

Bowtech Owner's Manuel for 2009 12 pages.
"Bowtech 2009" image (full picture of Compound Archery Bow).

* cited by examiner

COMPOUND ARCHERY BOW

The present disclosure is directed to compound archery bows, including cross bows, having pulleys at the ends of the bow limbs to control the force/draw characteristics of the bow, and more particularly to both single-cam bows having a power let-off cam mounted on the end of one of the bow limbs and dual-cam bows having power let-off cams mounted on the ends of both bow limbs.

BACKGROUND AND SUMMARY OF THE DISCLOSURE

Single-cam and dual-cam compound archery bows have a power cam mounted on one or both ends of the bow limbs to control the draw force on the bowstring and the bending of the limbs as the bowstring is drawn. In single-cam bows, there is a power cam on the end of one bow limb, and a wheel on the end of the other bow limb to facilitate control or time take-up of a power cable at the power cam and let-out of the bowstring at the power cam as the bow is drawn. In dual-cam bows, power cams are mounted on the ends of both bow limbs. A problem can arise in bows of these types in that rotating the cams too far results in complete let-off of the force on the bowstring, locking the cams at full draw. A general object of the present disclosure is to provide a stop on at least one of the pulleys at a position to be engaged by the power cable extending from that pulley to limit rotation of the pulley and let-out of the power cable during the draw cycle, and thereby prevent this cam-lock situation.

The present disclosure embodies a number of aspects that can be implemented separately from or in combination with each other.

A compound archery bow, in accordance with one aspect of the present disclosure, includes a bow handle having projecting limbs, and first and second pulleys mounted on the limbs for rotation around respective axes. A bow cable arrangement includes a bowstring cable extending from a bowstring anchor through a bowstring let-out groove on the first pulley and then toward the second pulley. A first power cable extends from a first power cable anchor through a power cable let-out arrangement on the first pulley toward the second pulley, and a second power cable extends from the second pulley through a power cable take-up arrangement on the first pulley to a second power cable anchor on the first pulley. Draw of the bowstring cable away from the handle lets out bowstring cable from the bowstring let-out groove and rotates the first pulley around the first axis, lets out the first power cable from the power cable let-out arrangement on the first pulley and takes up the second power cable into the second power cable take-up arrangement on the first pulley. A power cable stop is disposed on the first pulley at a position to be engaged by the first power cable as the first pulley is so rotated to inhibit further rotation of the first pulley and thereby inhibit further draw of the bowstring cable by limiting further let out of the power cable. The power cable stop may be adjustably disposed on one pulley or both pulleys for a more positive stop.

BRIEF DESCRIPTION OF THE DRAWINGS

The disclosure, together with additional objects, feature, advantages and aspects thereof, will best be understood from the following description, the appended claims and the accompanying drawings, in which:

FIGS. 9A and 9B are respective enlarged views of the portions of FIG. 9 in the areas 9A and 9B;

DETAILED DESCRIPTION OF PREFERRED EMBODIMENTS

Figure 1:
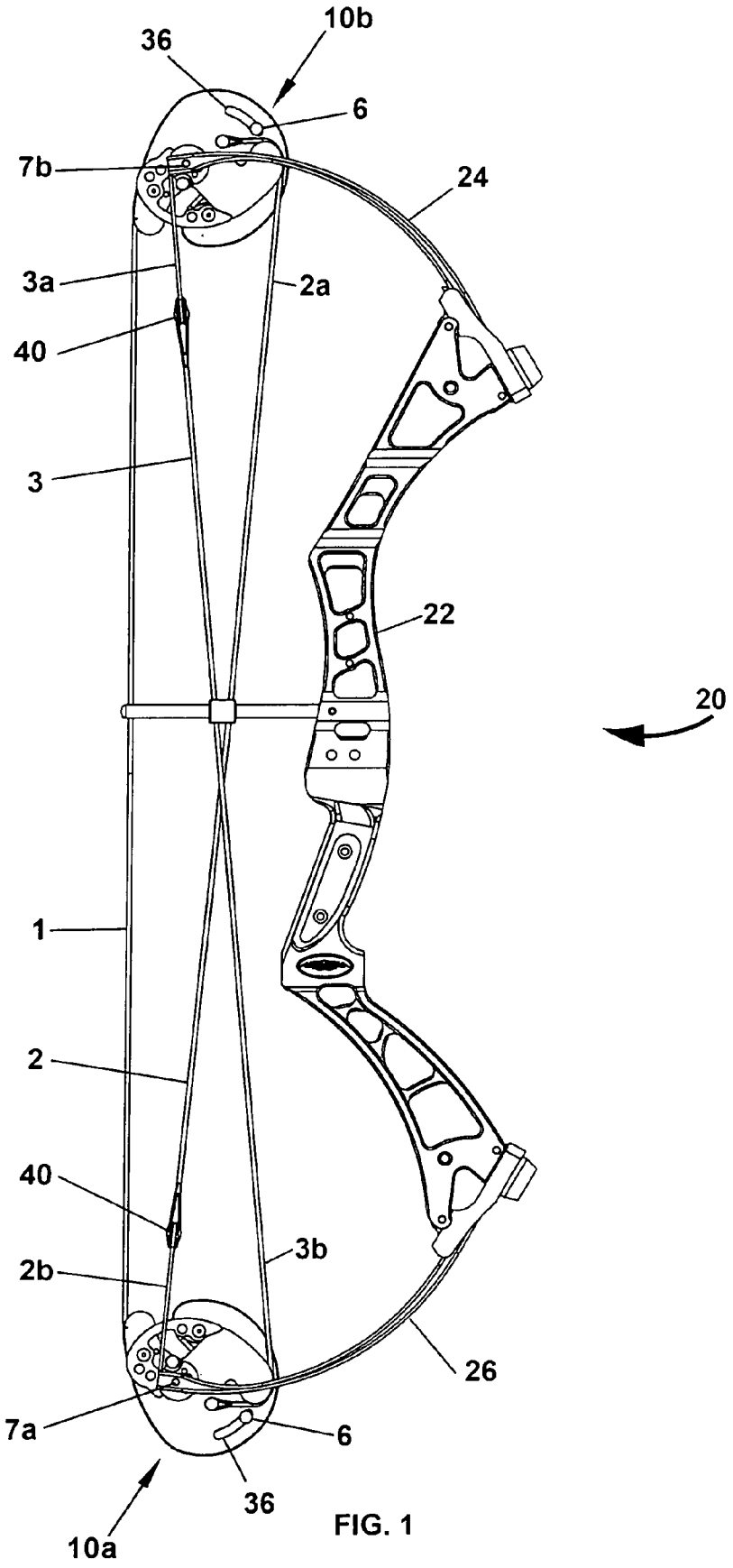
FIG. 1 is a side elevational view of a dual-cam archery bow in accordance with one exemplary embodiment of the present disclosure in an undrawn condition.
Figure 3:
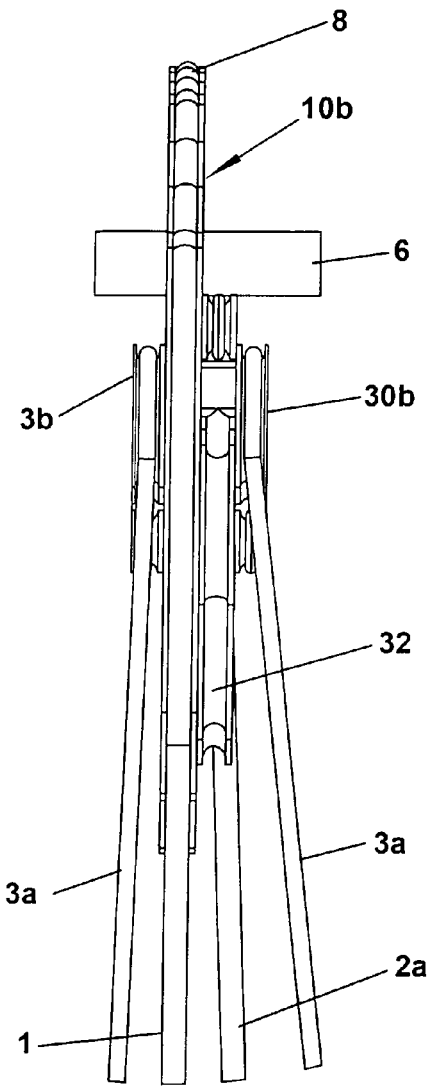
FIG. 3 is an enlargement of the portion of FIG. 2 within the area 3.

FIG. 1 illustrates a dual-cam bow 20 in accordance with one exemplary embodiment of the present disclosure as including a handle 22 of aluminum or other relatively rigid construction having spaced risers with bow-mounting surfaces at each end. A pair of flexible resilient limbs 24, 26 of fiber-reinforced resin or other suitable resilient construction are mounted on the respective handle risers and project away from handle 22. A lower pulley 10*a* is mounted on and end of limb 26 for rotation around an axle 7*a*, and an upper pulley 10*b* is mounted on an end of limb 24 for rotation around an axle 7*b*. Bow 20 of FIG. 1 is a dual-cam bow in which pulleys 10*a*, 10*b* are similar in functions and preferably near mirror images of each other.

Figure 2:
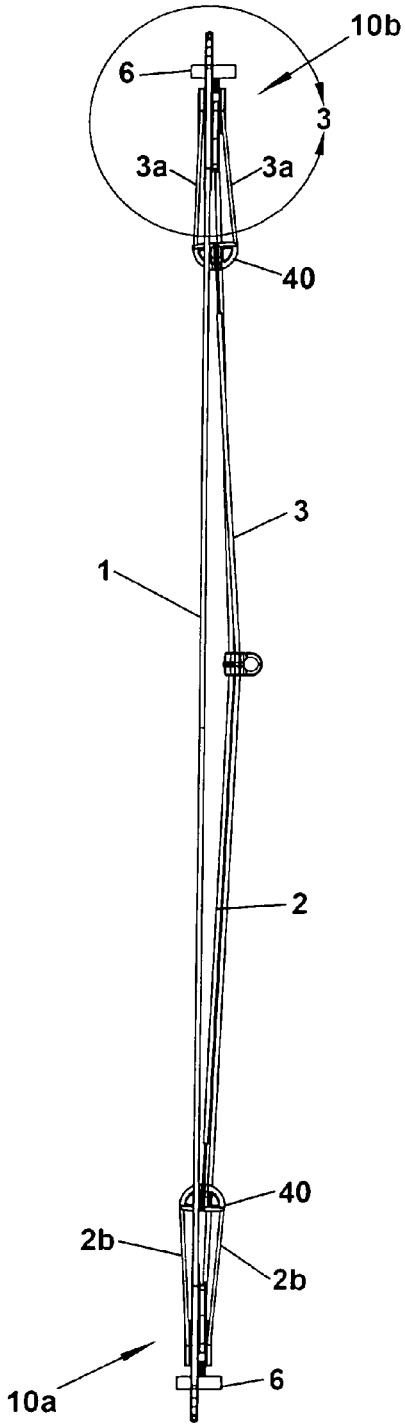
FIG. 2 is an end elevational view of the bow in FIG. 1.

A bowstring cable 1 (FIGS. 1-4) extends from an anchor 28*a* (FIG. 4) on pulley 10*a* through a bowstring let-out groove 8 extending around the periphery of pulley 10*a* toward pulley 10*b*. In the exemplary embodiment of FIGS. 1-4, bowstring cable 1 extends at pulley 10*b* through a bowstring let-out groove 8 around the periphery of the pulley to an anchor 28*b* (FIG. 4) on pulley 10*b*. A first power cable 2 extends from an anchor 5 on lower pulley 10*a* around a let-out wheel 30*a* toward pulley 10*b*, and then at pulley 10*b* through a portion of a power cable take-up groove 32 to an anchor 4. A second power cable 3 extends from a power cable let-out wheel 30*b* on pulley 10*b* toward pulley 10*a*, at which cable end 3*b* extends through a take-up groove 32 to an anchor 4. Let-out wheels 30*a*, 30*b* can be similar to those shown in U.S. Pat. No. 6,990,970B1. To balance the forces applied by power cable ends 2*b* and 3*a* on axles 7*a*, 7*b*, wheels 30*a*, 30*b* preferably are provided on both sides of pulleys 10*a*, 10*b*, and power cables 2, 3 have split ends joined by connectors 40 (FIGS. 1 and 2).

Figure 4:
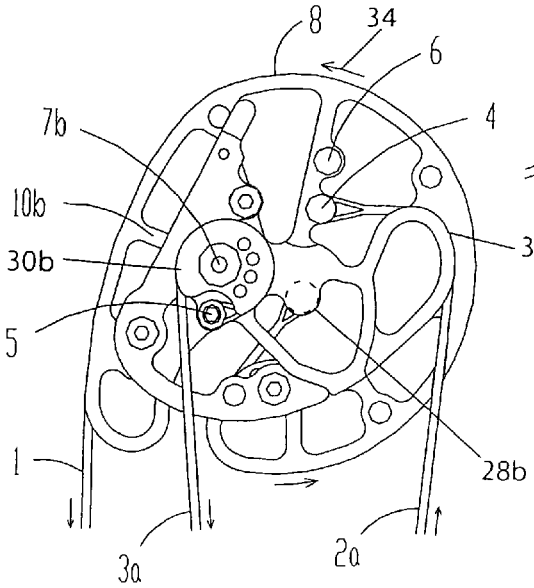
FIG. 4 is a fragmentary view on an enlarged scale of the pulleys in the bow of FIG. 1.
Figure 4:
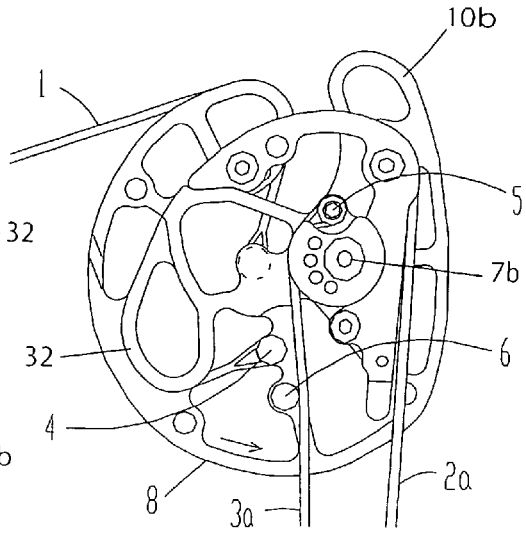
Figure 4:
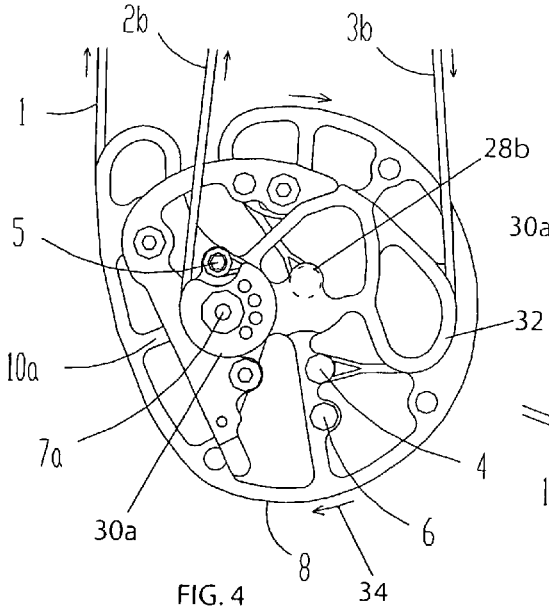
Figure 8:
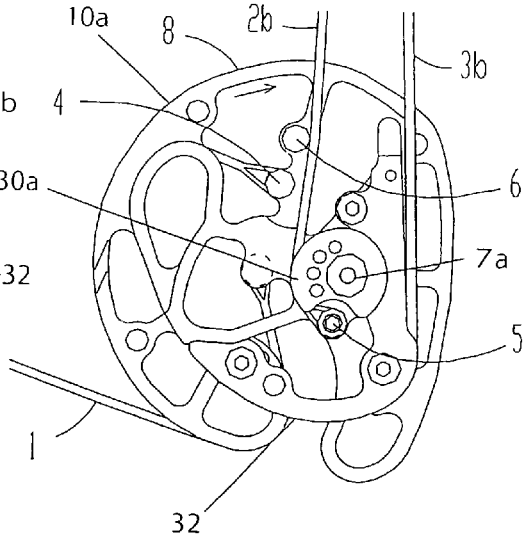
FIG. 8 is a fragmentary view on an enlarged scale of the pulleys in the fully drawn bow of FIG. 5.
Figure 5:
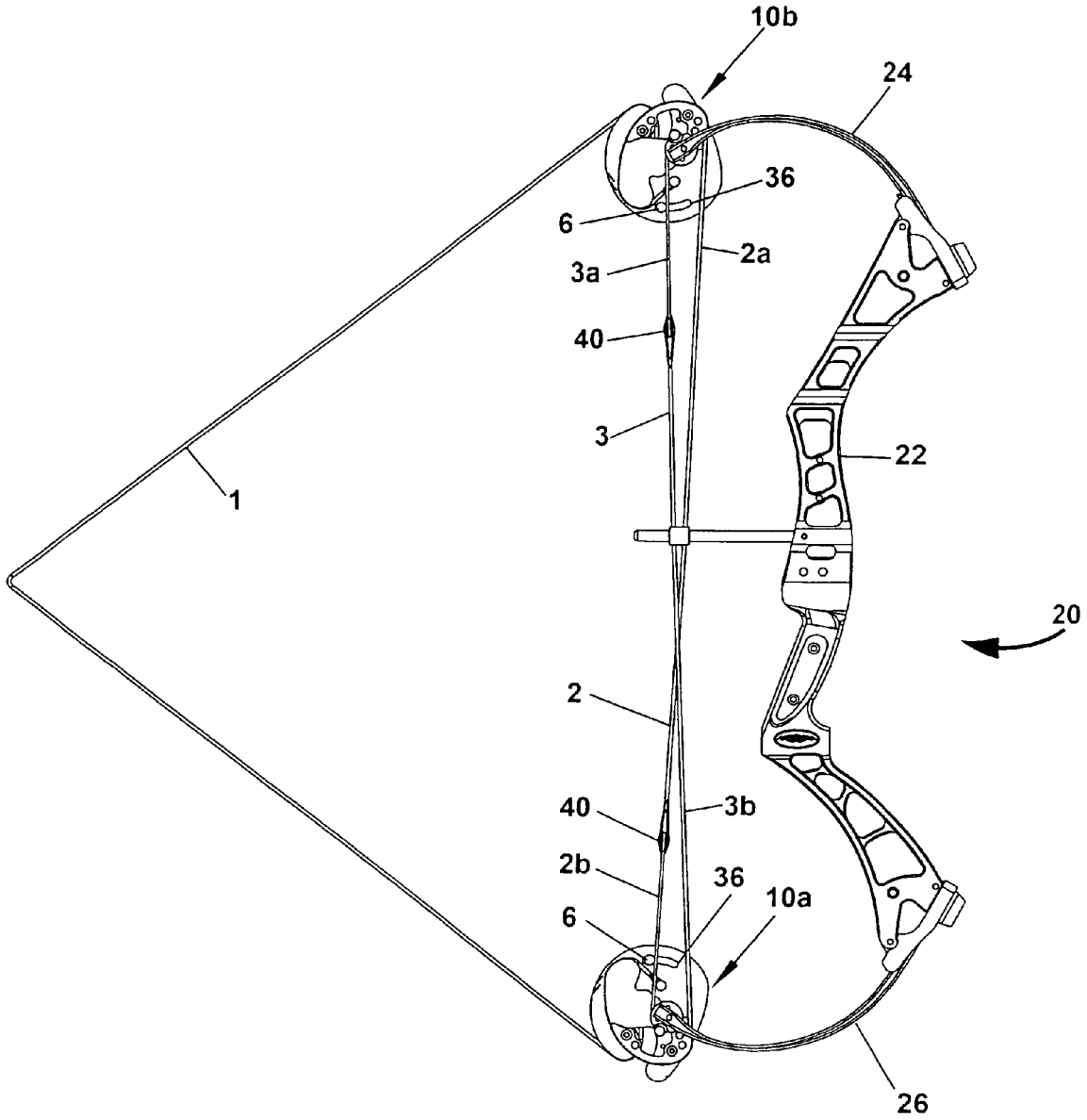
FIG. 5 is a side elevational view of the bow in FIG. 1 in the fully drawn condition.
Figure 7:
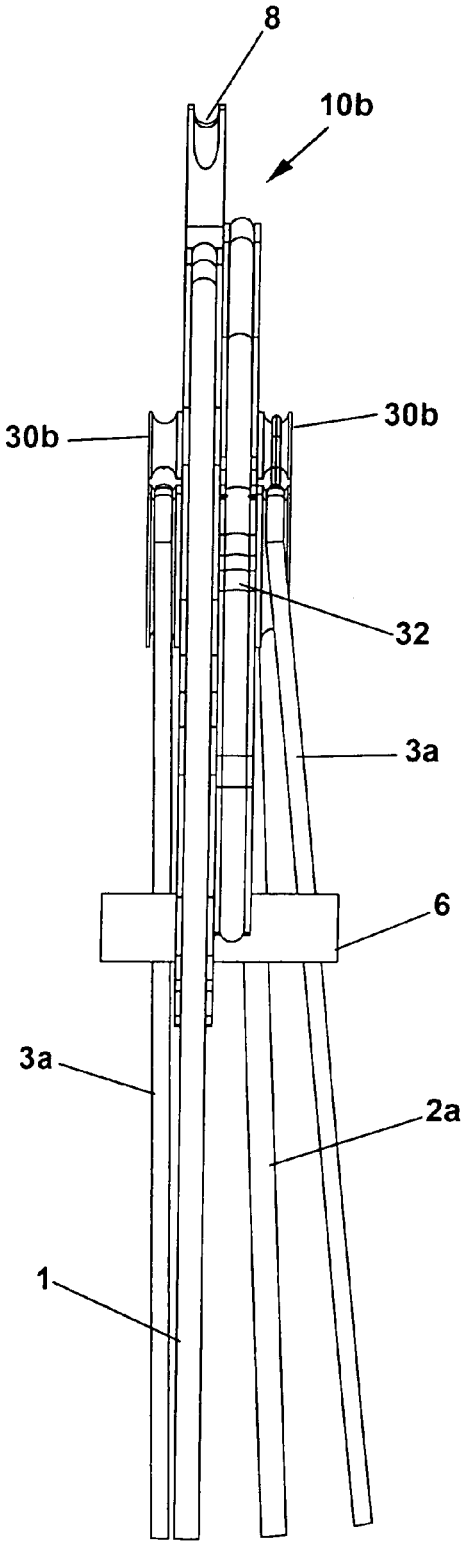
FIG. 7 is an enlarged view of the portion of FIG. 6 within the area 7.
Figure 6:
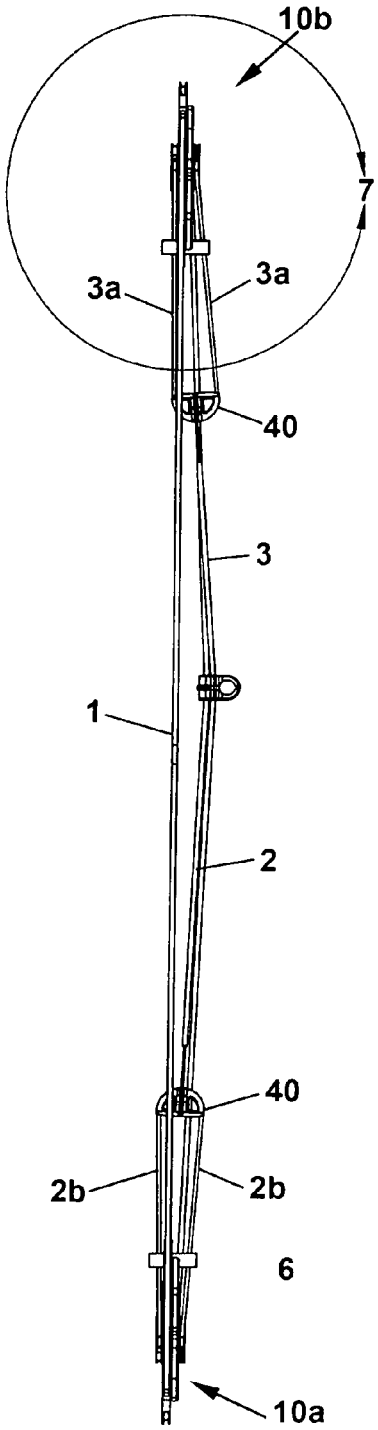
FIG. 6 is an end elevational view of the fully drawn bow in FIG. 5.

The directional arrows 34 in FIG. 4 illustrate the direction of movement of cables 1, 2 and 3, and of pulleys 10*a*, 10*b*, between the rest or undrawn condition of FIGS. 1-4 toward the fully drawn conditions of FIGS. 5-8 as bowstring 1 is drawn. As bowstring 1 is drawn away from handle 22, pulleys 10*a*, 10*b* rotate in the directions 34 letting out power cable ends 3*a*, 2*b* and taking up power cable ends 2*a*, 3*b*. Pulleys 10*a*, 10*b* include stops 6 that are disposed on the respective pulleys to abut power cable ends 2*b* at pulley 10*a* and power cable ends 3*a* at pulley 10*b*, as shown in FIG. 8, at the fully drawn positions of the respective pulleys illustrated in FIG. 8A. Engagement of stops 6 against cable ends 2*b*, 3*a* make further draw of bowstring cable 1 very difficult, so that stops 6 effectively define the full-draw position of the bowstring cable. In FIGS. 4 and 8, stops 6 are illustrated as being mounted in fixed position on the respective pulleys. FIGS. 1-3 and 5-7 illustrate a modification in which stops 6 are mounted in slots 36 on the respective pulleys for adjusting the full-draw position of the bow.

Figure 9:
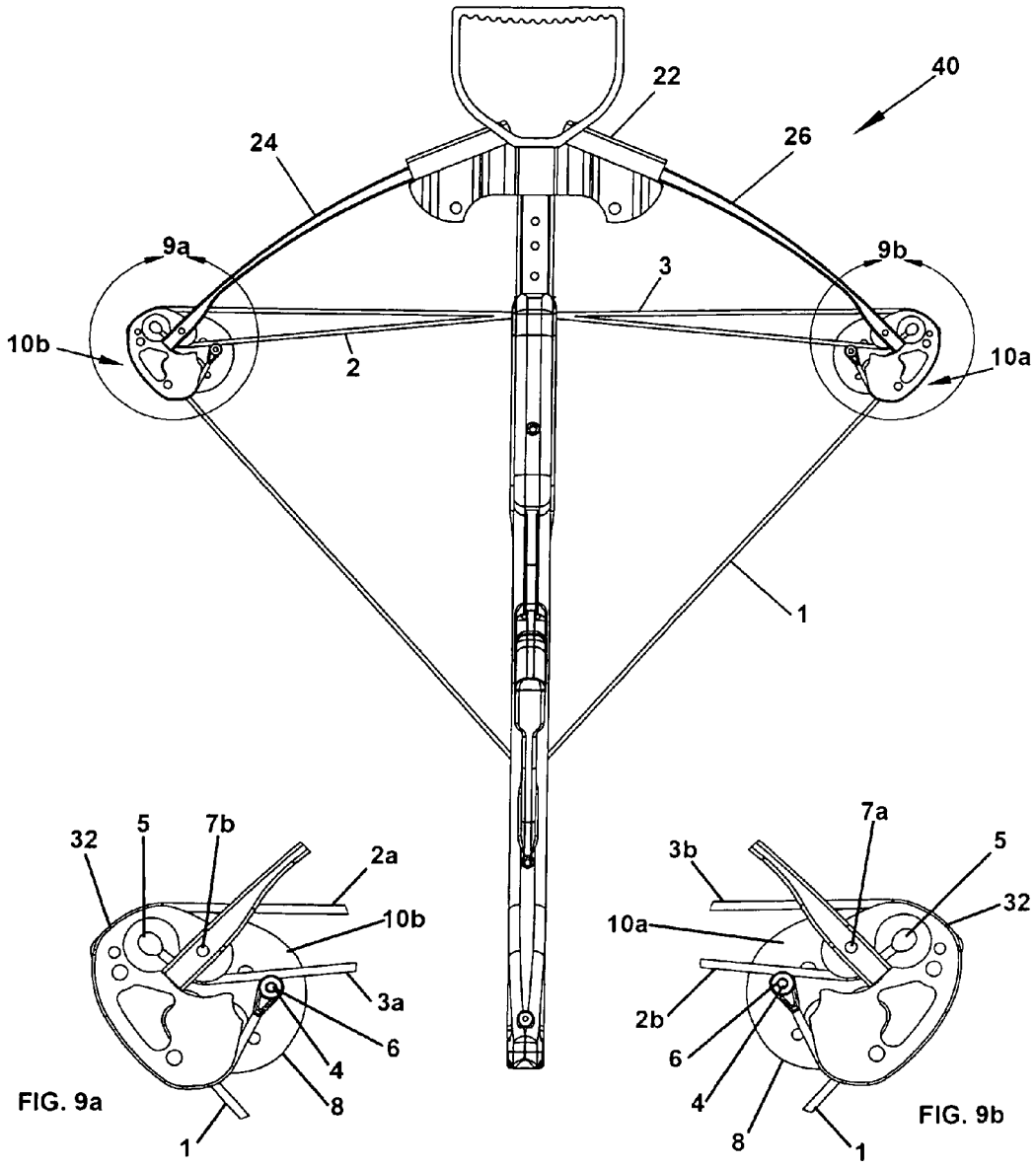
FIG. 9 is a bottom plan view of a crossbow in accordance with a second exemplary embodiment of the present disclosure in a fully drawn condition.
Figure 10:
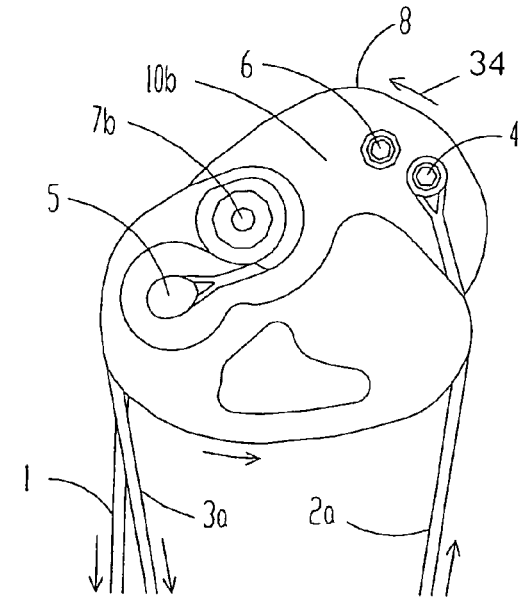
FIG. 10 is a fragmentary plan view of the pulleys in the bow of FIG. 9 in the undrawn condition.
Figure 10:
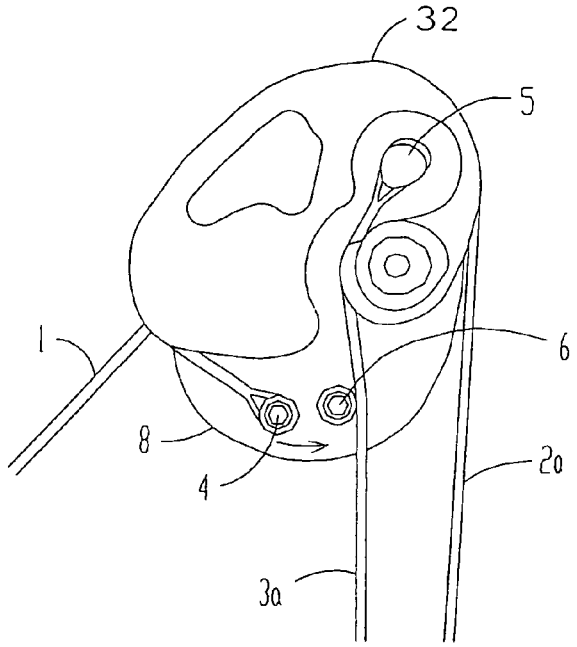
Figure 10:
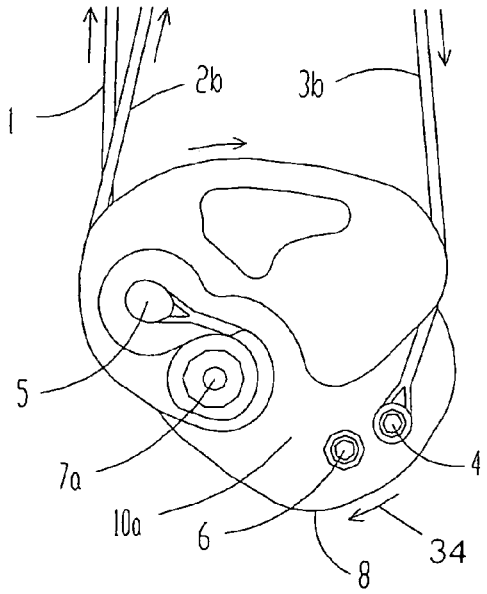
Figure 11:
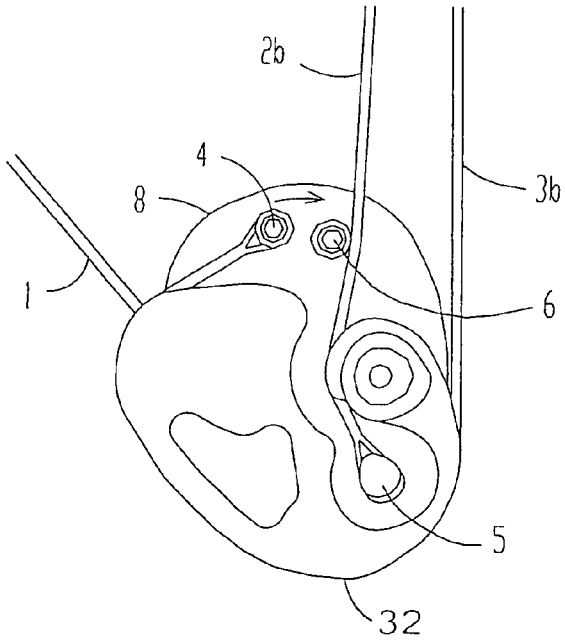
FIG. 11 is a fragmentary plan view similar to that of FIG. 10 but showing the pulleys in the fully drawn condition.

FIGS. 9-11 illustrate a crossbow 40 embodying the principles of the present disclosure. Elements similar in function to those described above in connection with FIGS. 1-8 are indicated by correspondingly identical reference numerals. FIG. 9 also illustrates a modification in which power cable anchor 4 and drawn stop 6 are combined in a single element rather than separate elements in the embodiment of FIGS. 1-8.

Pulleys 10*a*, 10*b* can be of any suitable construction. Each pulley preferably is comprised of a flat base having peripheral bowstring let-out groove 8, which can be circular or non-circular. Wheels 30*a*, 30*b* can be adjustably or non-adjustably mounted on the flat base and have peripheral power cable let-out grooves that can be circular or non-circular. Power cable take-up grooves 32 can be in one or more elements adjustably or non-adjustably mounted on the pulley base. Such elements can include a draw module adjustably and/or removably mounted on the pulley base to provide adjustment to the force/draw characteristics of the bow. See, for example, U.S. Pat. No. 6,516,790B1 and US RE37544E.

There thus has been disclosed a compound archery bow that fully satisfies all of the objects and aims previously set forth. The bow has been disclosed in conjunction with exemplary embodiments, and modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A compound archery bow that includes:

a bow handle having projecting limbs, a first pulley mounted on a first of said limbs for rotation around a first axis, a second pulley mounted on a second of said limbs for rotation around a second axis, bow cable means including a bowstring cable extending from a bowstring anchor through a bowstring let-out groove on said first pulley and then toward said second pulley, a first power cable extending from a first power cable anchor through power cable let-out means on said first pulley toward said second pulley, and a second power cable extending from said second pulley through power cable take-up means to a second power cable anchor on said first pulley, such that draw of said bowstring cable away from said handle lets out bowstring cable from said bowstring let-out groove, rotates said first pulley around said first axis, lets out said first power cable from said power cable let-out means on said first pulley and takes up said second power cable onto said power cable take-up means on said first pulley, and a power cable stop disposed on said first pulley and extending in opposite directions away from opposite sides of said first pulley at a position radially inward of the radially outer periphery of the first pulley, to be engaged by said first power cable adjacent to said let-out means to inhibit further rotation of said first pulley and draw of said bowstring cable, and thereby define a fully drawn position of said bowstring cable and said first pulley.

2. The compound archery bow set forth in claim 1 wherein said second power cable anchor on said first pulley is also said power cable stop on said first pulley.

3. The compound archery bow set forth in claim 1 wherein said bow is a dual-cam bow in which said first and second pulleys are similar in function and near mirror images of each other.

4. The compound archery bow set forth in claim 1 wherein said bow is a crossbow.

5. The compound archery bow set forth in claim 1 wherein said power cable stop engages said first power cable on both sides of said first pulley.

6. The compound archery bow set forth in claim 5 wherein said first power cable has split ends joined by a connector, such that said power cable stop engages said spilt ends at a location between said connector and said let-out groove.

7. A compound archery bow that includes:

a bow handle having projecting limbs, a first pulley mounted on a first of said limbs for rotation around a first axis a second pulley mounted on a second of said limbs for rotation around a second axis, a bowstring cable extending from a bowstring anchor through a bowstring let-out groove on said first pulley and then toward said second pulley, a first power cable extending from a first power cable anchor through a power cable let-out groove on said first pulley toward said second pulley, a second power cable extending from said second pulley through a power cable take-up groove to a second power cable anchor on said first pulley, a power cable stop disposed on said first pulley and extending in opposite directions away from opposite sides of said first pulley at a position radially inward of the radially outer periphery of said first pulley, such that draw of said bowstring cable away from said handle lets out bowstring cable from said bowstring let-out groove, rotates said first pulley around said first axis, lets out said first power cable from said power cable let-out groove on said first pulley and takes up said second power cable onto said power cable take-up groove on said first pulley until said power cable stop engages said first power cable at a location adjacent to said let-out groove to inhibit further rotation of said first pulley and draw of said bowstring cable, and thereby define a fully drawn position of said bowstring cable and said first pulley, wherein said power cable stop is adjustably disposed in a slot on said first pulley for adjustably varying said fully drawn position of said bow.

8. A compound archery bow that includes:

a bow handle having projecting limbs, a first pulley mounted on a first of said limbs for rotation around a first axis, a second pulley mounted on a second of said limbs for rotation around a second axis, a bowstring cable extending from a bowstring anchor through a bowstring let-out groove on said first pulley and then toward said second pulley, a first power cable extending from a first power cable anchor through a power cable let-out groove on said first pulley toward said second pulley, a second power cable extending from said second pulley through a power cable take-up groove to a second power cable anchor on said first pulley, a power cable stop disposed on said first pulley and extending in opposite directions away from opposite sides of said first pulley at a position radially inward of the radially outer periphery of said first pulley, such that draw of said bowstring cable away from said handle lets out bowstring cable from said bowstring let-out groove, rotates said first pulley around said first axis, lets out said first power cable from said power cable let-out groove on said first pulley and takes up said second power cable onto said power cable take-up groove on said first pulley until said power cable stop engages said first power cable at a location adjacent to said let-out groove to inhibit further rotation of said first pulley and draw of said bowstring cable, and thereby define a fully drawn position of said bowstring cable and said first pulley.

9. The compound archery bow set forth in claim 8 wherein said power cable stop engages said first power cable on both sides of said first pulley.

10. The compound archery bow set forth in claim 9 wherein said first power cable has split ends joined by a connector, such that said power cable stop engages said spilt ends at a location between said connector and said let-out groove.

11. The compound archery bow set forth in claim 10 wherein said power cable stop is adjustably disposed in an arcuately extending slot on said first pulley for adjustably varying said fully drawn position of said bow.

* * * * *